US006476307B2

(12) United States Patent
Hikawa

(10) Patent No.: US 6,476,307 B2
(45) Date of Patent: Nov. 5, 2002

(54) METHOD OF COMPRESSING, TRANSFERRING AND REPRODUCING MUSICAL PERFORMANCE DATA

(75) Inventor: Kazuo Hikawa, Yokohama (JP)

(73) Assignee: Victor Company of Japan, Ltd., Yokohama (JP)

( * ) Notice: Subject to any disclaimer, the term of this patent is extended or adjusted under 35 U.S.C. 154(b) by 0 days.

(21) Appl. No.: 09/978,090

(22) Filed: Oct. 17, 2001

(65) Prior Publication Data

US 2002/0043151 A1 Apr. 18, 2002

(30) Foreign Application Priority Data

Oct. 18, 2000 (JP) ..... 2000-317837
Aug. 23, 2001 (JP) ..... 2001-252612

(51) Int. Cl.[7] ..... G10H 1/057; G10H 1/26
(52) U.S. Cl. ..... 84/609; 84/626
(58) Field of Search ..... 84/609–620, 626–633

(56) References Cited

U.S. PATENT DOCUMENTS 5,869,782 A * 2/1999 Shishido et al. ..... 84/609
5,886,277 A * 3/1999 Takauji ..... 84/609 X

FOREIGN PATENT DOCUMENTS

JP 09-016168 1/1997

* cited by examiner

*Primary Examiner*—Stanley J. Witkowski
(74) *Attorney, Agent, or Firm*—Jacobson Holman PLLC

(57) ABSTRACT

Music-performance data is separated into at least note-number data, musical note-velocity data, musical note-length data and other necessary data. A primary encoded code is formed in which the note-number data, the musical note-velocity data, the musical note-length data and the other necessary data are arranged in different data fields. The primary encoded code and a playback player are compressed, the playback player being formed in software having a primary encoded code decoding function to decode the primary encoded code into the data arranged in the different data fields for reproducing the music-performance data, thus forming a first secondary encoded code for the primary encoded code and a second secondary encoded code for the playback player. The first secondary encoded code is decoded into the primary encoded code of the music-performance data. The second secondary encoded code is decoded into the playback player. The primary encoded code is decoded by the playback player, thus reproducing the music-performance data.

16 Claims, 4 Drawing Sheets

METHOD OF COMPRESSING, TRANSFERRING AND REPRODUCING MUSICAL PERFORMANCE DATA

BACKGROUND OF THE INVENTION

The present invention relates to methods of compressing, transferring and reproducing data such as video data and audio data (musical performance data).

Known hand-held communications devices such as cellular telephones have a function of melody signaling for incoming calls using a part of music of several kinds in addition to monotonous melody.

These melodies are pre-stored on hand-held communications devices (terminals). In addition, for users who want to use popular songs for melody signaling, such songs are downloaded to user hand-held communications devices from a database provided in a server.

The downloaded data are reproduced by reproducing circuitry or software stored in ROM, RAM or memory device built in the hand-held communications devices.

As for melody signaling, MIDI (Musical Instrument Digital Interface) data is better than PCM audio data (musical performance data) for data amount. However, even though MIDI is used, whole song data is required when hand-held communications devices such as cellular telephones are used as audio playback systems. But the transmission rate is limited and the data amount for each communications device is limited so that everyone can use the services.

MIDI data is also used for other entertainment systems such as a "karaoke" system, a machine that plays recorded music which people can sing along. A "karaoke" system requires necessary data not only whole song data but also character data for displaying lyrics of recorded "karaoke" music and background image data, for example.

This results in a long downloading time and shortage of storage capacity of the internal memory device a hand-held communications device due to increasing the offer data for the multi-media application and so on in the total data amount even though a data amount is small for MIDI data.

MIDI music-performance data is generally written as a standard MIDI file (called SMF hereinafter). However, due to relatively large size for SMF, special formats for melody signaling for incoming calls such as MFi, SMAF and Compact MIDI Formats are used instead.

Compression ratios for these special formats are, however, almost half that for SMF, and hence improvement in compression ratio is necessary.

Melody signaling data for incoming calls is protected against unauthorized use in a closed network such as i-mode, provided by a Japanese cellular telephone company, for cellular telephones to access Internet.

However, standard data SMFs formed and provided by contents makers at high cost could be used by unauthorized persons when used for melody signaling in a new service in which melody signaling data can be downloaded via an open network in future.

In other words, standard data SMFs are convenient for ordinary users, and there are various types of off-the-shelf MIDI application softwares. It is thus convenient for ordinary users and contents makers to distribute standard data SMFs compressed as they are, via an open network.

SUMMARY OF THE INVENTION

A purpose of the present invention is to provide methods of data compression, transfer and reproduction that achieve decrease in data amount for music-performance data files and protection of the files against unauthorized use.

The present invention provides a data compression method including the following steps. Music-performance data is separated into at least note-number data, musical note-velocity data, musical note-length data and other necessary data. A primary encoded code is formed in which the note-number data, the musical note-velocity data, the musical note-length data and the other necessary data are arranged in different data fields. The primary encoded code and a playback player are compressed, the playback player being formed in software having a primary encoded code decoding function to decode the primary encoded code into the data arranged in the different data fields for reproducing the music-performance data, thus forming a first secondary encoded code for the primary encoded code and a second secondary encoded code for the playback player.

Moreover, the present invention provides a data decompression method including the following steps. A first secondary encoded code is decoded into a primary encoded code of music-performance data in which at least note-number data, musical note-velocity data, musical note-length data and other necessary data are arranged in different data fields. A second secondary encoded code is decoded into a playback player formed in software having a primary encoded code decoding function to decode the primary encoded code into the data arranged in the different data fields for reproducing the music-performance data. The primary encoded code is decoded by the playback player, thus reproducing the music-performance data.

Furthermore, the present invention provides a method of decompressing a first secondary encoded code and a second secondary encoded code. The method includes the following steps. The first secondary encoded code is decoded into a primary encoded code of music-performance data in which at least note-number data, musical note-velocity data, musical note-length data and other necessary data are arranged in different data fields. The second secondary encoded code is decoded into a playback player formed in software having a primary encoded code decoding function to decode the primary encoded code into the data arranged in the different data fields for reproducing the music-performance data. The primary encoded code is decoded by the playback player, thus reproducing the music-performance data.

Furthermore, the present invention provides a decompression method including the following steps. A combined code is separated into a lyric data and a first secondary encoded code. The first secondary encoded code is decoded into a primary encoded code of music-performance data in which at least note-number data, musical note-velocity data, musical note-length data and other necessary data are arranged in different data fields. A second secondary encoded code is decoded into a playback player formed in software having a primary encoded code decoding function to decode the primary encoded code into the data arranged in the different data fields for reproducing the music-performance data. The primary encoded code is decoded by the playback player, thus reproducing the music-performance data.

Moreover, the present invention provides a method of decompressing a combined code of a lyric data and a first secondary encoded code, and also decompressing a second secondary encoded code. The method includes the following steps. The combined code is separated into the lyric data and the first secondary encoded code. The first secondary encoded code is decoded into a primary encoded code of music-performance data in which at least note-number data, musical note-velocity data, musical note-length data and other necessary data are arranged in different data fields. The second secondary encoded code is decoded into a playback player formed in software having a primary encoded code decoding function to decode the primary encoded code into the data arranged in the different data fields for reproducing the music-performance data. The primary encoded code is decoded by the playback player, thus reproducing the music-performance data.

Moreover, the present invention provides a data compression method including the following steps. Music-performance data is separated into at least note-number data, musical note-velocity data, musical note-length data and other necessary data. A primary encoded code is formed in which the note-number data, the musical note-velocity data, the musical note-length data and the other necessary data are arranged in different data fields. The primary encoded code is compressed into a secondary encoded code. A playback player is compressed that is formed in software having a secondary encoded code decoding function to decode the secondary encoded code into the primary encoded code and a primary encoded code decoding function to decode the primary encoded code into the data arranged in the different data fields for reproducing the music-performance data.

Moreover, the present invention provides a data decompression method including the following steps. A secondary encoded code is decoded into a primary encoded code of music-performance data in which at least note-number data, musical note-velocity data, musical note-length data and other necessary data are arranged in different data fields. A compressed playback player is decoded into a playback player formed in software having a primary encoded code decoding function to decode the primary encoded code into the data arranged in the different data fields for reproducing the music-performance data. The primary encoded code is decoded by the playback player, thus reproducing the music-performance data.

Furthermore, the present invention provides a method of decompressing a secondary encoded code and a compressed playback player. The method includes the following steps. The secondary encoded code is decoded into a primary encoded code of music-performance data in which at least note-number data, musical note-velocity data, musical note-length data and other necessary data are arranged in different data fields. The compressed playback player is decoded into a playback player formed in software having a secondary encoded code decoding function to decode the secondary encoded code into the primary encoded code and a primary encoded code decoding function to decode the primary encoded code into the data arranged in the different data fields for reproducing the music-performance data. The primary encoded code is decoded by the playback player, thus reproducing the music-performance data.

Further more, the present invention provides a decompression method including the following steps. A combined code is separated into a lyric data and a secondary encoded code. The secondary encoded code is decoded into a primary encoded code of music-performance data in which at least note-number data, musical note-velocity data, musical note-length data and other necessary data are arranged in different data fields. A compressed playback player is decoded into a playback player formed in software having a secondary encoded code decoding function to decode the secondary encoded code into the primary encoded code and a primary encoded code decoding function to decode the primary encoded code into the data arranged in the different data fields for reproducing the music-performance data. The primary encoded code is decoded by the playback player, thus reproducing the music-performance data.

Moreover, the present invention provides a method of decompressing a combined code of a lyric data and a secondary encoded code, and also decompressing a compressed playback player. The method includes the following steps. The combined code is separated into the lyric data and the secondary encoded code. The secondary encoded code is decoded into a primary encoded code of music-performance data in which at least note-number data, musical note-velocity data, musical note-length data and other necessary data are arranged in different data fields. The compressed playback player is decoded into a playback player formed in software having a secondary encoded code decoding function to decode the secondary encoded code into the primary encoded code and a primary encoded code decoding function to decode the primary encoded code into the data arranged in the different data fields for reproducing the music-performance data. The primary encoded code is decoded by the playback player, thus reproducing the music-performance data.

DETAILED DESCRIPTION OF PREFERRED EMBODIMENTS

Preferred embodiments of methods of data compression, transfer and reproduction according to the present invention will be disclosed with reference to the attached drawings.

<First Embodiment>

Figure 1:
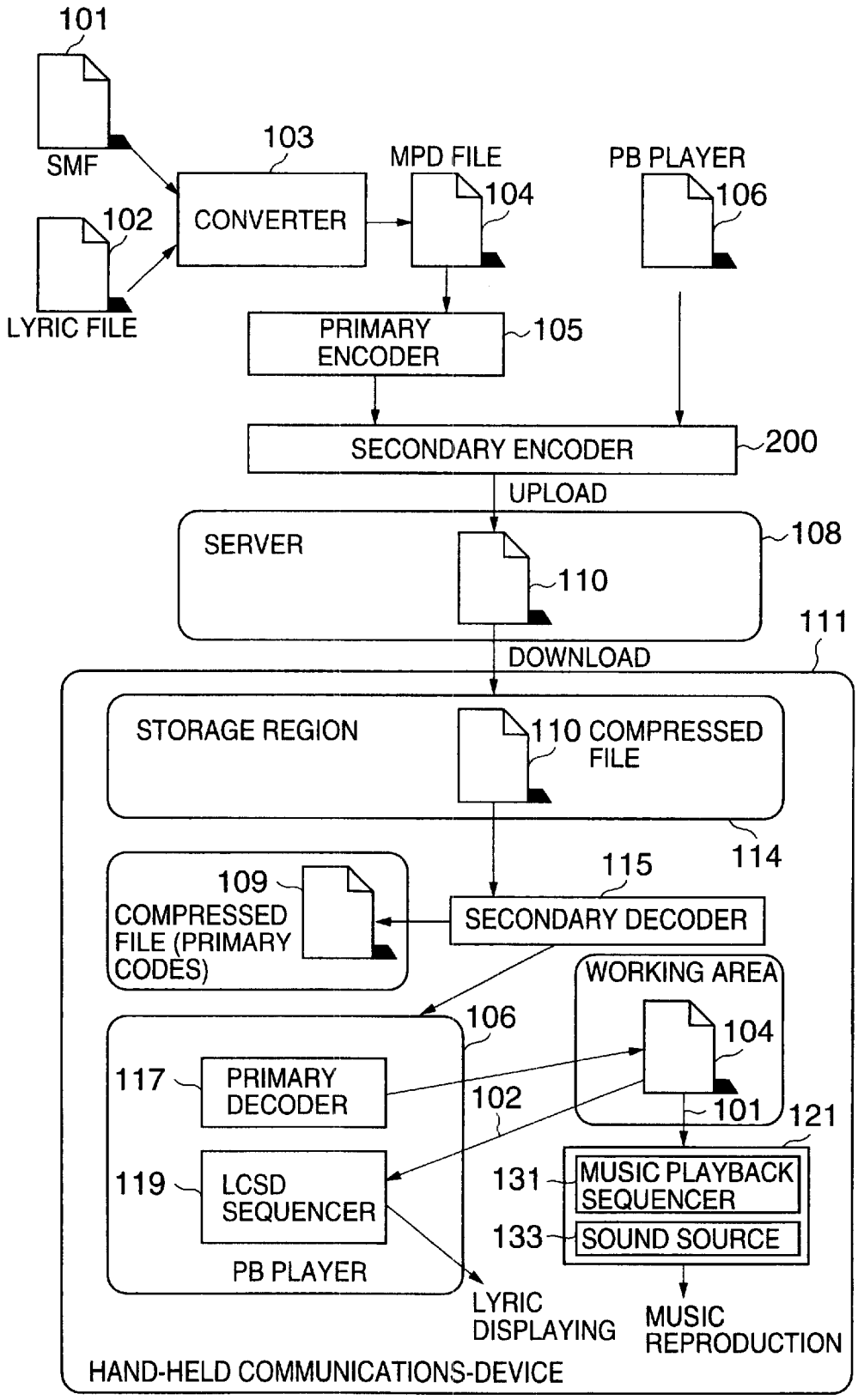
FIG. 1 shows a block diagram for illustrating a first embodiment of methods of data compression, transfer and reproduction according to the present invention.

FIG. 1 shows a block diagram for illustrating a first embodiment of methods of data compression, transfer and reproduction according to the present invention.

An original music-performance data 101 is formed as an SMF (Standard MIDI File), and hence called an SMF 101. Not only that, the data 101 may be formed as special formats for melody signaling for incoming calls such as MFi, SMAF and Compact MIDI, as mentioned above.

A lyric file 102 includes lyric text data, switching-timing data for text color, data for text locations on display, data for text fonts and switching-timing data for pages, used for displaying lyric characters corresponding to the SMF 101.

The SMF 101 and the lyric file 102 are converted by a converter 103 into a music-performance data file 104, a single file to be distributed.

The music-performance data (called MPD hereinafter) file 104 may be formed in a special file format in which note-number data (key-number data), musical note-velocity data (note-volume data), musical note-length data and other necessary data can be written, another special format for melody signaling for incoming calls such as MFi, SMAF and Compact MIDI or an SMF.

The converted MPD file 104 is subjected to primary encoding by a primary encoder 105 and then secondary encoding by a secondary encoder 200. Combination of the two types of encoding techniques achieves efficient compression of musical data compared to the known LZ (Lempel-Zif)-technique. In detail, before LZ compression, note-numbers, note-velocities, note-length and other data are separated from musical data so that long identical data patterns appear at a close distance. Primary codes in which the separated data are provided separately are generated and compressed by the LZ compression, thus the musical data being compressed efficiently, like disclosed in U.S. Pat. No. 5,869,782.

A playback (called PB hereinafter) player 106 formed in software is also subjected to secondary encoding by the secondary encoder 200.

In detail, the primarily encoded MPD file 104 and the PB player 106 are both encoded into a single compressed file 110 by the secondary encoder 200. The compressed file 110 is uploaded to a server 108.

In response to a user request, the compressed file 110 is downloaded from the server 108 to a storage region 114 on a hand-held communications device 111.

The downloaded file 110 is sent to a secondary decoder 115 for reproduction of the SMF 101 and the lyric file 102 when a user desires. The secondary decoder 115 decodes the compressed file 110 so that it is separated into the PB player 106 and a compressed file 109 in which secondary codes have been decoded into primary codes.

The PB player 106 includes a primary decoder 117 for decoding the compressed file 109 that contains the primary codes decoded from the secondary codes and a lyric color-switching display (called LCSD hereinafter) sequencer 119 for playing the SMF 101 and displaying character colors that are switched according as the music is played.

The compressed file 109 that contains the primary codes is further decoded into the MPD file 104 by the primary decoder 117. The MPD file 104 is sent to a working area 126 and separated into the SMF 101 and the lyric file 102.

The SMF 101 is sent to a music reproducer 121 having a music playback sequencer 131 and a sound source 133. The lyric file 102 is sent to the PB player 106, respectively. The music reproducer 121 processes the SMF 101 to play music while the LCSD sequencer 119 processes the lyric file 102 to display lyrics.

Reproduction of the SMF 101 is disclosed. Data in the SMF 101 are sequentially reproduced by the music playback sequencer 131 and sequentially sent to the sound source 133. The sound source 133 plays music through a speaker (not shown) in accordance with the SMF 101. The file format for the SMF 101 is not limited to SMF, which may be a special format for melody signaling for incoming calls such as MFi, SMAF and Compact MIDI, as already mentioned.

The lyric file 102 is sent to the LCSD sequencer 119 of the PB player 106 so that lyrics are displayed on a monitor screen (not shown) in synchronism with the sequencer. The lyric text may only be displayed. The lyric color may be switched while music is played if the monitor has such power. The PB player 106 may also include the music playback sequencer 131 and the sound source 133 instead of the music reproducer 121 in FIG. 1.

The primary encoder 105 and the secondary encoder 200 separate the music-performance data into note-number (key-number), note velocity (note-volume), note length and other data and arrange the separated data in different data fields so that long identical data patterns appear many times at a close distance. In detail, the primary encoder 105 separates the music-performance data into note-number, note velocity, note length and other data and generates the primary codes in which the separated data are arranged in different data fields. The secondary encoder 200 compresses the data in the different data fields of the primary codes by LZ (Lempel-Zif) compression etc., to generate the secondary codes.

Reproduction of the compressed MPD file 109 requires the primary decoder 117 of the PB player 106. Then, in this embodiment, correlation is given between the MPD file 104 and the PB player 106 or applies IDs or digital watermarks to the file 104 and the player 106 to allow reproduction only when their correlation is made or IDs or the digital watermarks match each other between the file 104 and the player 106. Correlation between the MPD file 104 and the PB player 106 can be made, for example, with ID codes, so that the MPD file 104 cannot be reproduced when the ID codes, for the MPD file 104 and the PB player 106 do not match each other.

It is thus achieved that the MPD file 104 cannot be directly accessed and played by any player different from the PB player 106.

Decrease in data amount is also achieved for the MPD file 104 because of primary and secondary encoding.

There are several combinations for the MPD file 104 and the PB player 106, for example, as disclosed, the MPD file 104 is subjected to primary encoding and the primarily encoded file 104 and the PB player 106 are subjected to secondary encoding to form the single compressed file 110 for downloading. Or, the primarily encoded file 104 may be downloaded having correlation with the PB player 106.

<Second Embodiment>

Figure 2:
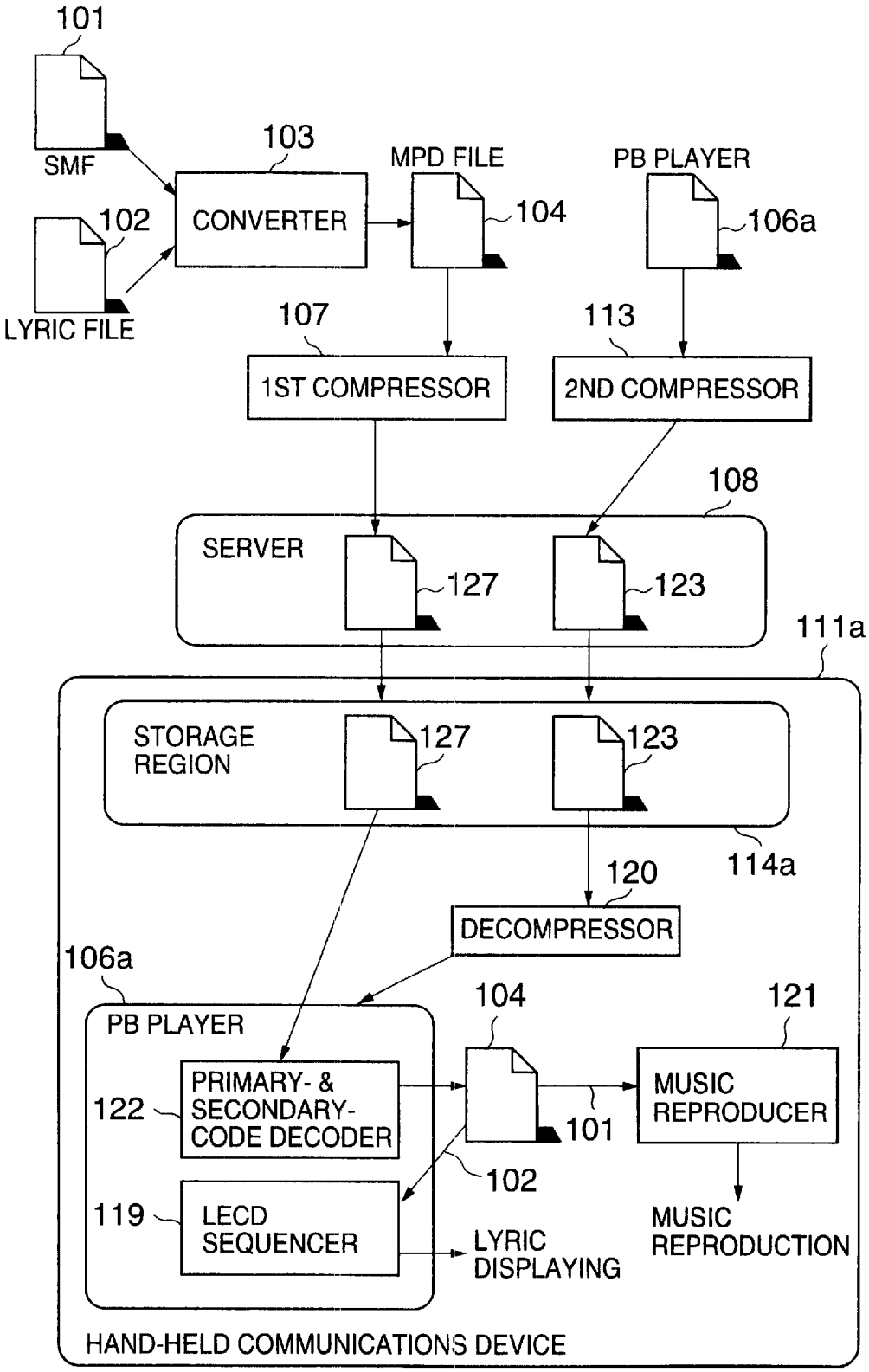
FIG. 2 shows a block diagram for illustrating a second embodiment of methods of data compression, transfer and reproduction according to the present invention.

Disclosed next with reference to FIG. 2 is a second embodiment of methods of data compression, transfer and reproduction according to the present invention.

Elements in this embodiment that are the same as or analogous to elements in the first embodiment are referenced by the same reference numbers and will not be explained in detail.

In the same way as the first embodiment, the SMF 101 and the lyric file 102 are converted by the converter 103 into the music-performance data (MPD) file 104.

In the second embodiment, however, the MPD file 104 is compressed into a compressed file 127 by a first compressor 107 that may perform the primary and the second encoding such as disclosed in the first embodiment.

The following disclosure is made when the first compressor 107 performs the primary and the second encoding.

A playback (PB) player **106*a* formed in software includes a decoder (disclosed layer) for decoding a music-performance data file compressed by the primary and the second encoding. The PB player 106*a* is compressed into a compressed file 123 by a second compressor 113. The compressed file 123 is uploaded to the server 108**.

The compressed file 127 to which the MPD file 104 has been compressed is also uploaded to the server 108 as a tune file.

In response to a user request, the compressed MPD file (compressed file 127) and the compressed PB player (compressed file 123) are downloaded from the server 108 to a storage region **114*a* on a hand-held communications device 111*a*. Although not shown, the storage region 114*a* may be divided into two regions for the compressed files 127 and 123**, respectively.

The compressed file 123 (compressed PB player) is decoded or decompressed by a decompressor 120 in accordance with a decompression method that is the reversal of the method performed by the second compressor 113, to obtain the decompressed PB player 106*a* having a primary- and secondary-code decoder 122 and the lyric color-switching display (LCSD) sequencer 119.

The compressed file (compressed MPD file) 127 is decompressed into the decoded MPD file 104 by the primary- and secondary-code decoder 122.

The decoded MPD file 104 is separated into the SMF 101 and the lyric file 102. The lyric file 102 is sent to the LCSD sequencer 119 for displaying lyrics. The SMF 101 is sent to the music reproducer 121 for sound reproduction.

The primary- and secondary-code decoder 122 is used in the second embodiment, as contained in the PB player 106*a*, for decompressing the first compressor 107. A compression algorism for the first compressor 107 and a decompression algorism for the decoder 122 to decompress the compressor 107 may not be limited those described in this embodiment.

The second embodiment includes the hand-held communications device 111*a*. However, not only this, the present invention is applicable to other systems such as home electric appliances, communications devices for automobile use and immobile telephone sets that have limited storage capacity and also limited network traffic capacity.

Moreover, the present invention has the advantage of saving storage capacity for storage media such as memory chards having limited capacity when used for storing downloaded files as they are.

<Third Embodiment>

Figure 3:
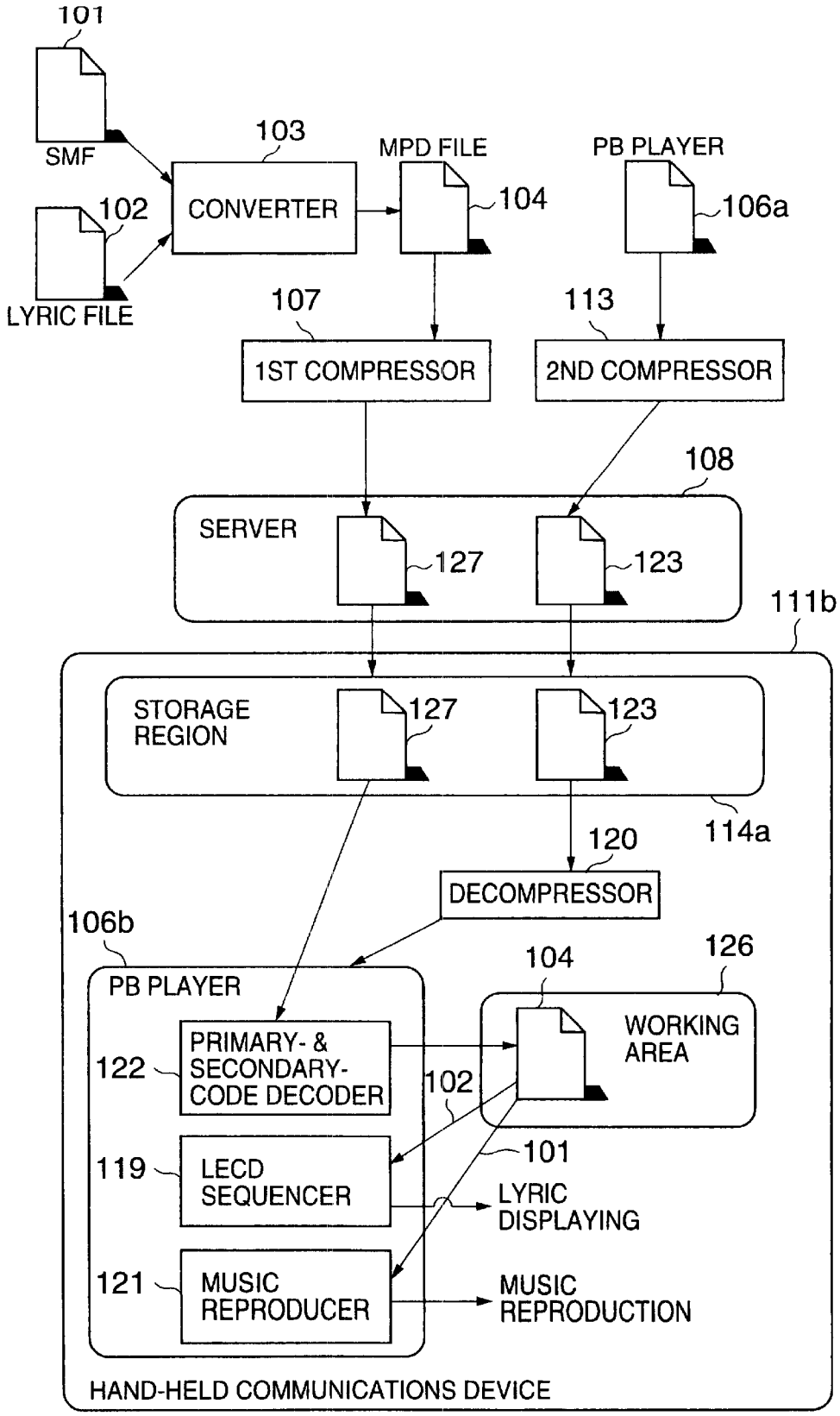
FIG. 3 shows a block diagram for illustrating a third embodiment of methods of data compression, transfer and reproduction according to the present invention.

FIG. 3 shows a block diagram for illustrating a third embodiment of methods of data compression, transfer and reproduction according to the present invention.

Elements in this embodiment that are the same as or analogous to elements in the second embodiment are referenced by the same reference numbers and will not be explained in detail.

In the second embodiment, the primary- and secondary-code decoder 122 and the lyric color-switching display (LCSD) sequencer 119 for displaying lyrics from the lyric file 102 are contained in the playback (PB) player 106 whereas the music reproducer 121 for reproducing the SMF 101 is provided separately in the hand-held communications device 111*a*.

In contrast, the primary- and secondary-code decoder 122, the LCSD sequencer 119 and the audio reproducer 121 may be contained in a playback player 106*b* as shown in FIG. 3 according to the third embodiment.

In this embodiment, the first compressor 107 uses an undisclosed unique compression algorism and the primary- and secondary-code decoder 122 are also undisclosed, thus constructing a contents-distributing model that prevents creation of illegal servers with unauthorized use of contents.

<Fourth Embodiment>

Figure 4:
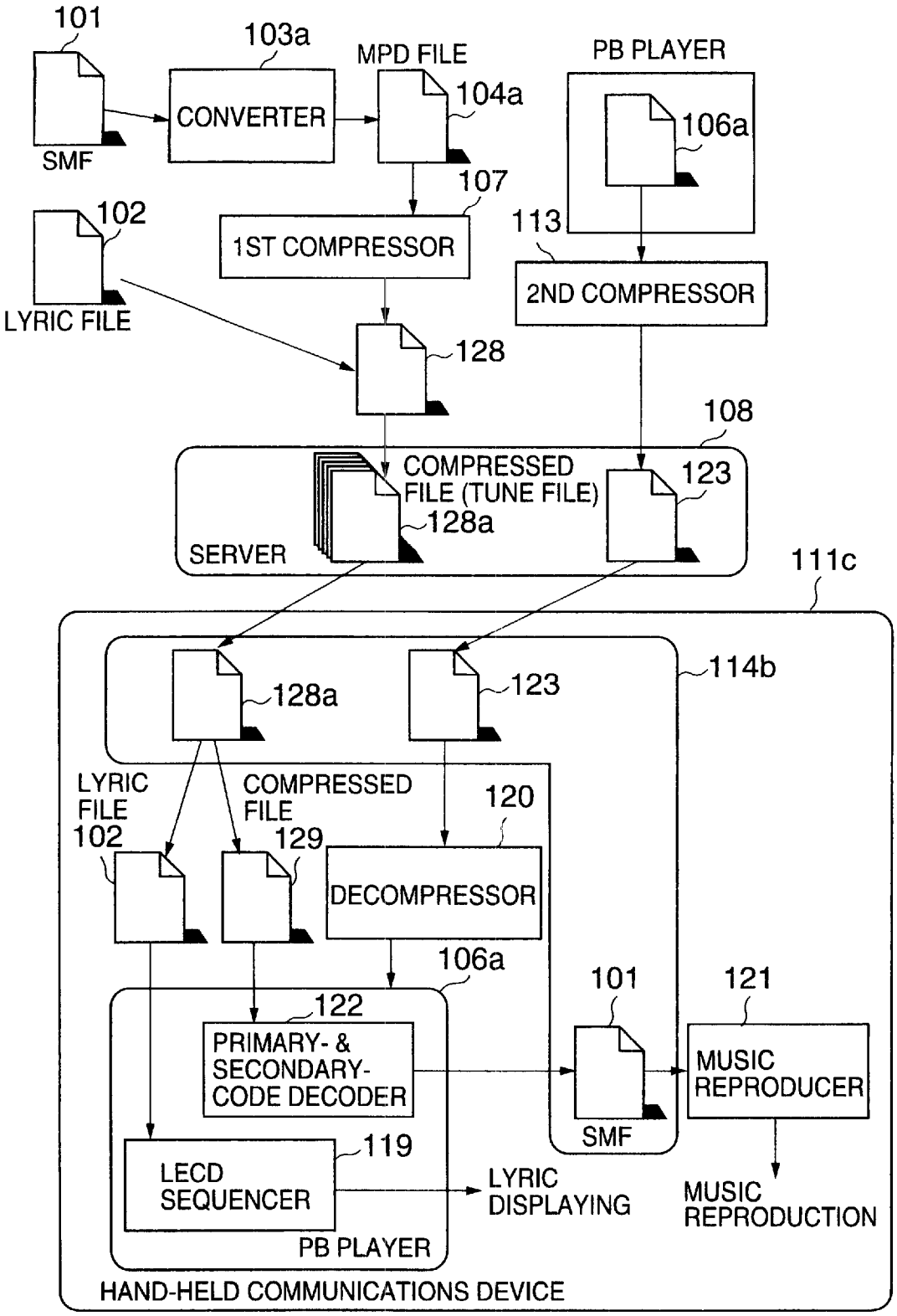
FIG. 4 shows a block diagram for illustrating a fourth embodiment of methods of data compression, transfer and reproduction according to the present invention.

FIG. 4 shows a block diagram for illustrating a fourth embodiment of methods of data compression, transfer and reproduction according to the present invention.

Elements in this embodiment that are the same as or analogous to elements in the second embodiment are referenced by the same reference numbers and will not be explained in detail.

In the second and the third embodiments in FIGS. 2 and 3, respectively, the SMF 101 and the lyric file 102 are converted into the single music-performance data (MPD) file 104 by the converter 103 and compressed by the first compressor 107.

On the contrary, in the forth embodiment, the SMF file 101 is only converted into an MPD file 104*a* by a converter 103*a*. The MPD file 104*a* is compressed into a compressed file 128 by the first compressor 107. The compressed file 128 is combined with the uncompressed lyric file 102, thus forming a compressed file 128*a*.

The compressed file 128*a* (the compressed file 128 combined with the uncompressed lyric file 102) is uploaded to the server 108 as a tune file, like the second and the third embodiments in FIGS. 2 and 3, respectively.

The uploaded MPD file (compressed file 128*a*) and also the uploaded playback (PB) player (compressed file 123) are downloaded from the server 108 to a storage region 114*b* on a hand-held communications device 111*c*. Although not shown, the storage region 114*b* may be divided into two regions for the compressed files 128*a* and 123, respectively.

The compressed file 123 (compressed PB player) is decompressed by the decompressor 120, to obtain the decompressed PB player 106*a* having the primary- and secondary-code decoder 122 and the lyric color-switching display (LCSD) sequencer 119.

The compressed file 128*a* is separated into the lyric file 102 and a compressed file 129. The compressed file 129 is decompressed into the MPD file 104*a* and further reconverted into the SMF 101 by the primary- and secondary-code decoder 122. The SMF 101 is once stored in the storage region 114*b* and sent to the audio music reproducer 121 for sound reproduction. The lyric file 102 is sent to the LCSD sequencer 119 for displaying lyrics.

The primary- and secondary-code decoder 122 is used in the fourth embodiment, as contained in the PB player 106*a*, for decompressing the first compressor 107. A compression algorism for the first compressor 107 and a decompression algorism for the decoder 122 to decompress the compressor 107 may not be limited those described in this embodiment.

As disclosed above, the methods of data compression, transfer and reproduction in the present invention achieve decrease in data amount for music-performance data files. The present invention thus has the advantages of shortened time for downloading files to hand-held communications devices and saving storage capacity for the devices.

Moreover, according to the present invention, a compressed music-performance data file is transferred or downloaded with a playback player having a decompressor for decompressing the compressed music-performance data file, so that the file cannot be reproduced by other types of playback player. The music-performance data file thus can be protected against unauthorized use.

What is claimed is:

1. A data compression method comprising the steps of:

separating music-performance data into at least note-number data, musical note-velocity data, musical note-length data and other necessary data;

forming a primary encoded code in which the note-number data, the musical note-velocity data, the musical note-length data and the other necessary data are arranged in different data fields; and compressing the primary encoded code and a playback player formed in software having a primary encoded code decoding function to decode the primary encoded code into the data arranged in the different data fields for reproducing the music-performance data, thus forming a first secondary encoded code for the primary encoded code and a second secondary encoded code for the playback player.

2. The data compression method according to claim 1 further comprising the steps of:

making correlation between the first secondary encoded code and the second secondary encoded code; and transferring the first secondary encoded code and the second secondary encoded code having the correlation therebetween.

3. The data compression method according to claim 1 further comprising the step of combing the first secondary encoded code with lyric data, thus forming a combined code.

4. The data compression method according to claim 3 further comprising the steps of:

making correlation between the second secondary encoded code and the combined code; and transferring the second secondary encoded code and the combined code having the correlation therebetween.

5. A data decompression method comprising the steps of:

decoding a first secondary encoded code into a primary encoded code of music-performance data in which at least note-number data, musical note-velocity data, musical note-length data and other necessary data are arranged in different data fields;

decoding a second secondary encoded code into a playback player formed in software having a primary encoded code decoding function to decode the primary encoded code into the data arranged in the different data fields for reproducing the music-performance data; and decoding the primary encoded code by the playback player, thus reproducing the music-performance data.

6. A method of decompressing a first secondary encoded code and a second secondary encoded code, the method comprising the steps of:

decoding the first secondary encoded code into a primary encoded code of music-performance data in which at least note-number data, musical note-velocity data, musical note-length data and other necessary data are arranged in different data fields;

decoding the second secondary encoded code into a playback player formed in software having a primary encoded code decoding function to decode the primary encoded code into the data arranged in the different data fields for reproducing the music-performance data; and decoding the primary encoded code by the playback player, thus reproducing the music-performance data.

7. A decompression method comprising the steps of:

separating a combined code into a lyric data and a first secondary encoded code;

decoding the first secondary encoded code into a primary encoded code of music-performance data in which at least note-number data, musical note-velocity data, musical note-length data and other necessary data are arranged in different data fields;

decoding a second secondary encoded code into a playback player formed in software having a primary encoded code decoding function to decode the primary encoded code into the data arranged in the different data fields for reproducing the music-performance data; and decoding the primary encoded code by the playback player, thus reproducing the music-performance data.

8. A method of decompressing a combined code of a lyric data and a first secondary encoded code, and also decompressing a second secondary encoded code, the method comprising the steps of:

separating the combined code into the lyric data and the first secondary encoded code;

decoding the first secondary encoded code into a primary encoded code of music-performance data in which at least note-number data, musical note-velocity data, musical note-length data and other necessary data are arranged in different data fields;

decoding the second secondary encoded code into a playback player formed in software having a primary encoded code decoding function to decode the primary encoded code into the data arranged in the different data fields for reproducing the music-performance data; and decoding the primary encoded code by the playback player, thus reproducing the music-performance data.

9. A data compression method comprising the steps of:

separating music-performance data into at least note-number data, musical note-velocity data, musical note-length data and other necessary data;

forming a primary encoded code in which the note-number data, the musical note-velocity data, the musical note-length data and the other necessary data are arranged in different data fields;

compressing the primary encoded code into a secondary encoded code; and compressing a playback player formed in software having a secondary encoded code decoding function to decode the secondary encoded code into the primary encoded code and a primary encoded code decoding function to decode the primary encoded code into the data arranged in the different data fields for reproducing the music-performance data.

10. The data compression method according to claim 9 further comprising the steps of:

making correlation between the secondary encoded code and the compressed playback player; and transferring the secondary encoded code and the compressed playback player having the correlation therebetween.

11. The data compression method according to claim 9 further comprising the step of combing the secondary encoded code with lyric data, thus forming a combined code.

12. The data compression method according to claim 11 further comprising the steps of:

making correlation between the combined code and the compressed playback player; and transferring the combined code and the compressed playback player having the correlation therebetween.

13. A data decompression method comprising the steps of:

decoding a secondary encoded code into a primary encoded code of music-performance data in which at least note-number data, musical note-velocity data, musical note-length data and other necessary data are arranged in different data fields;

decoding a compressed playback player into a playback player formed in software having a primary encoded code decoding function to decode the primary encoded code into the data arranged in the different data fields for reproducing the music-performance data; and decoding the primary encoded code by the playback player, thus reproducing the music-performance data.

14. A method of decompressing a secondary encoded code and a compressed playback player, the method comprising the steps of:

decoding the secondary encoded code into a primary encoded code of music-performance data in which at least note-number data, musical note-velocity data, musical note-length data and other necessary data are arranged in different data fields;

decoding the compressed playback player into a playback player formed in software having a secondary encoded code decoding function to decode the secondary encoded code into the primary encoded code and a primary encoded code decoding function to decode the primary encoded code into the data arranged in the different data fields for reproducing the music-performance data; and decoding the primary encoded code by the playback player, thus reproducing the music-performance data.

15. A decompression method comprising the steps of:

separating a combined code into a lyric data and a secondary encoded code;

decoding the secondary encoded code into a primary encoded code of music-performance data in which at least note-number data, musical note-velocity data, musical note-length data and other necessary data are arranged in different data fields;

decoding a compressed playback player into a playback player formed in software having a secondary encoded code decoding function to decode the secondary encoded code into the primary encoded code and a primary encoded code decoding function to decode the primary encoded code into the data arranged in the different data fields for reproducing the music-performance data; and decoding the primary encoded code by the playback player, thus reproducing the music-performance data.

16. A method of decompressing a combined code of a lyric data and a secondary encoded code, and also decompressing a compressed playback player, the method comprising the steps of:

separating the combined code into the lyric data and the secondary encoded code;

decoding the secondary encoded code into a primary encoded code of music-performance data in which at least note-number data, musical note-velocity data, musical note-length data and other necessary data are arranged in different data fields;

decoding the compressed playback player into a playback player formed in software having a secondary encoded code decoding function to decode the secondary encoded code into the primary encoded code and a primary encoded code decoding function to decode the primary encoded code into the data arranged in the different data fields for reproducing the music-performance data; and decoding the primary encoded code by the playback player, thus reproducing the music-performance data.

* * * * *